US006681501B1

(12) United States Patent
Polifroni

(10) Patent No.: US 6,681,501 B1
(45) Date of Patent: Jan. 27, 2004

(54) ARCH SUPPORT DEVICE

(75) Inventor: Joseph P. Polifroni, Solana Beach, CA (US)

(73) Assignee: Dr.'s Own, Inc., Solano Beach, CA (US)

( * ) Notice: Subject to any disclaimer, the term of this patent is extended or adjusted under 35 U.S.C. 154(b) by 0 days.

(21) Appl. No.: 10/253,732

(22) Filed: Sep. 24, 2002

(51) Int. Cl.[7] ..... A43B 7/06; A43B 13/38

(52) U.S. Cl. ..... 36/3 B; 36/43; 36/147; 36/174; 36/91

(58) Field of Search ..... 36/3 B, 43, 147, 36/146, 174, 180, 91

(56) References Cited

U.S. PATENT DOCUMENTS

| | | | | | |
|---|---|---|---|---|---|
| 532,429 | A | * | 1/1895 | Rogers | 36/28 |
| 1,137,387 | A | * | 4/1915 | Dunbar | 36/146 |
| 1,146,899 | A | | 7/1915 | Parmelee | |
| 1,517,170 | A | * | 11/1924 | Rosenthal | 36/146 |
| 2,027,757 | A | * | 1/1936 | Whitefield et al. | 36/147 |
| 2,408,792 | A | | 10/1946 | Margolin | |
| 2,432,533 | A | * | 12/1947 | Margolin | 36/3 B |
| 2,486,653 | A | | 11/1949 | Hukill | |
| 2,771,691 | A | | 11/1956 | Luchs | |
| 2,821,032 | A | | 1/1958 | Helfet | |
| 2,978,818 | A | | 4/1961 | Baumann | |
| 3,081,774 | A | | 3/1963 | Lelyveld | |
| 3,135,265 | A | | 6/1964 | Holzman | |
| 3,306,967 | A | | 2/1967 | Turkewitsch | |
| 3,333,353 | A | | 8/1967 | Garcia | |
| 3,543,765 | A | * | 12/1970 | Alzner | 36/147 |
| 4,541,184 | A | | 9/1985 | Leighton | |
| 4,571,857 | A | | 2/1986 | Castellanos | |
| 4,619,056 | A | | 10/1986 | Lin et al. | |
| 4,702,255 | A | | 10/1987 | Schenkl | |
| 4,739,765 | A | * | 4/1988 | Sydor et al. | 36/174 |
| D302,071 | S | | 7/1989 | Chang | |
| D306,651 | S | | 3/1990 | Chang | |
| D313,306 | S | | 1/1991 | Chang | |
| 5,463,824 | A | | 11/1995 | Barna | |
| 5,611,153 | A | | 3/1997 | Fisher et al. | |
| 6,178,662 | B1 | | 1/2001 | Legatzke | |
| D446,913 | S | | 8/2001 | Holden | |
| 6,345,455 | B1 | | 2/2002 | Greer, Jr. et al. | |
| D461,039 | S | | 8/2002 | Polifroni | |
| D461,300 | S | | 8/2002 | Hall | |
| D462,510 | S | | 9/2002 | Goodrich et al. | |

OTHER PUBLICATIONS

Phase 4 Orthotics Advertisement, www.phase4orthotics.com, printed Dec. 21, 2001, original date unknown.

Ortho–Dynamics CEO Executive Internet Ad, orthodynamics.com/ceo.html, Dec. 21, 2002.

Feet Relief Original Flexifly, Leather Flexify, Sport Flexifly, www.feetrelief.com; printed Dec. 21, 2001, original date unknown.

* cited by examiner

*Primary Examiner*—Ted Kavanaugh
(74) *Attorney, Agent, or Firm*—Brown, Martin, Haller & McClain LLP

(57) ABSTRACT

An arch support has a periphery shaped to conform to at least part of the periphery of the sole of a wearer's footwear and an upper surface contoured to follow the contours of the sole of a wearer's foot, the upper surface having a heel region extending from the rear end, an arch region, and a forward region extending to the forward end. The forward region has an upwardly convex contour extending across part of its area, and the lower surface has a waffled region lying under the forward region which has a plurality of indents forming a waffle pattern, the indents being separated by dividing walls which are relatively thin compared to the width of each recess, for increased flexibility.

15 Claims, 2 Drawing Sheets

ARCH SUPPORT DEVICE

BACKGROUND OF THE INVENTION

The present invention relates to arch support devices for insertion in footwear in order to provide better comfort and support for the wearer's foot, as well as more correct positioning of the foot.

Many individuals who are on their feet or walking for significant periods of time encounter problems usually associated with uncomfortable or poorly fitting footwear. Such problems often arise as a result of insufficient arch support in conventional footwear. Various types of shoe inserts have been devised in order to alleviate such problems. Some inserts consist only of a foam or padded cushion member, and provide no arch support. More sophisticated arch supports are molded of rigid or semirigid materials to follow the contour of the sole of a wearer's foot more precisely. However, an arch support which is too rigid will not flex sufficiently with the wearer's foot, and can be uncomfortable.

It is known to make arch supports out of rigid or semirigid plastic material, with a pattern of indents on the undersurface of the support in thicker regions to enhance flexibility. For example, U.S. Pat. No. 3,543,765 of Alzner describes an arch support with an area of raised convex configuration in the forward region, and the undersurface in the forward region has a series of square, waffle-like indentations for providing flexibility in the thickest region of the support.

SUMMARY OF THE INVENTION

It is an object of the present invention to provide a new and improved arch support device with enhanced flexibility in the thickest region of the support.

According to the present invention, an arch support device is provided, which comprises a support member having a periphery shaped to conform to at least part of the periphery of the sole of a wearer's footwear, the member having a longitudinal axis, an upper surface, a lower surface, a forward end, and a rear end, the upper surface being contoured to follow the contours of the sole of a wearer's foot, the upper surface having a heel region extending from the rear end, an arch region, and a forward region extending to the forward end, each region being designed to lie under the corresponding regions of a wearer's foot when in use, the forward region having an upwardly convex contour extending across part of its area, the lower surface having a waffled region lying under the forward region which has a plurality of indents, the indents forming a waffle pattern, and a plurality of ribs extending transverse to one another across the waffled region to separate the shaped indents. The ratio of the thickness of a rib to the width of the indent is in the range from 1:3 to 1:6.

In an exemplary embodiment, the indents are polygonal shape having non-perpendicular corners, and may be of diamond shape, but may alternatively be hexagonal, octagonal or other multi-sided shapes. The diamond shape indentations each have two opposite acute angle corners and two opposite obtuse angle corners, and in an exemplary embodiment the acute angle corners all lie on lines coincident with or parallel to the longitudinal axis of the support member. The waffled region is of generally rectangular shape with an arcuate front end following the contour of the forward end of the support member. Triangular shaped indents are provided around the periphery of the waffled region to fill any corresponding triangular gaps between adjacent diamond-shaped indents at the periphery.

The shape of the polygonal indents, along with the ratio of the peripheral wall or rib thickness to the width of each indent, provides more flexibility and elasticity than thicker-walled indents. This arrangement is less restrictive and rigid than prior art arch supports with square indents, and is more accommodating and comfortable to the foot.

BRIEF DESCRIPTION OF THE DRAWINGS

The present invention will be better understood from the following detailed description of same exemplary embodiments of the invention, taken in conjunction with the accompanying drawings in which like reference numerals refer to like parts and in which.

DETAILED DESCRIPTION OF THE DRAWINGS

FIGS. 1 to 4 of the drawings illustrate an arch support device 10 according to an exemplary embodiment of the invention. The device is of molded, semi-rigid plastic material which is shaped to follow the contours of the sole of a user's foot, and is designed to be placed in footwear with the lower surface 12 of FIG. 2 facing downwardly and the upper surface 14 facing upwardly. The arch support device may be full length, as in the illustrated embodiment, corresponding substantially to the length of the sole of the footwear in which it is placed, or may be ¾ length, extending from the heel up to a location adjacent the toe region of the foot, as is known in the field. The device will be made in various lengths and widths to accommodate the entire range of footwear sizes.

Figure 1:
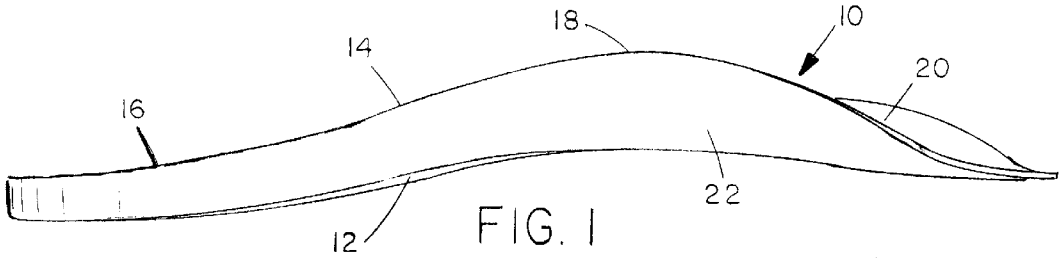
FIG. 1 is a side view of the arch support according to one embodiment of the invention.
Figure 4:
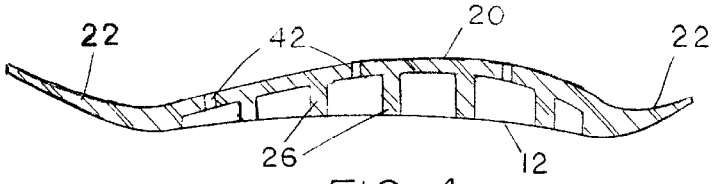
FIG. 4 is a sectional view taken on line 4—4 of FIG. 2.

The upper surface 14 of the device is shaped to provide a heel region 16 for lying under a wearer's heel, an intermediate or arch region 18, and a forward region 20 which lies generally under the ball of the wearer's foot. The periphery of the device is generally curved upwardly, to form a raised or cup-like rim 22, as best illustrated in FIGS. 1 and 4, which will help to position the wearer's foot properly. The rim is deeper in the heel and intermediate region than in the forward region of the device.

Figure 2:
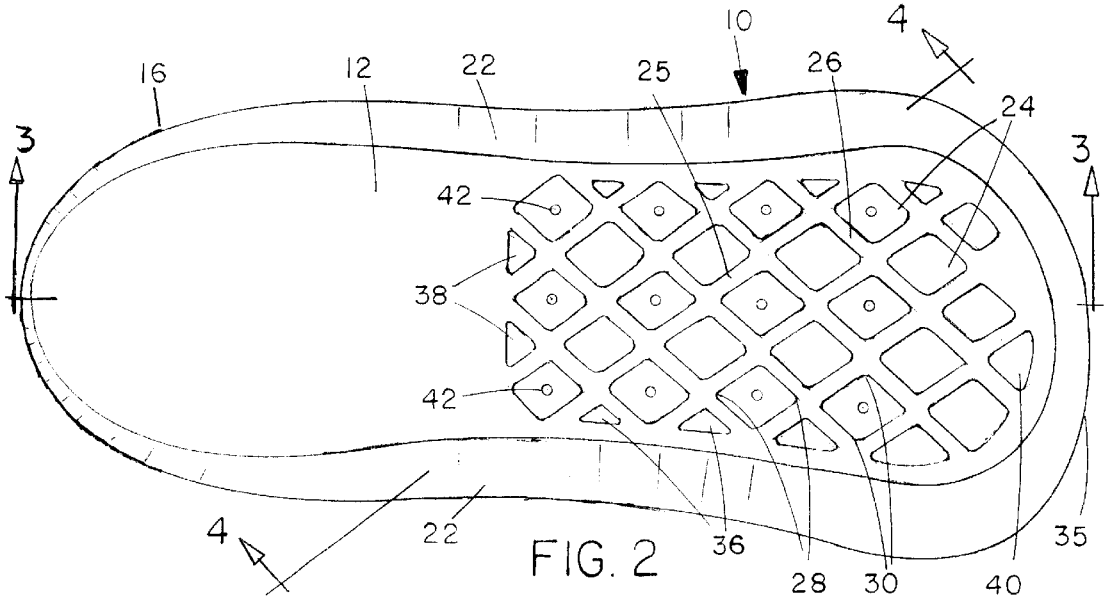
FIG. 2 is a bottom plan view of the arch support.
Figure 3:
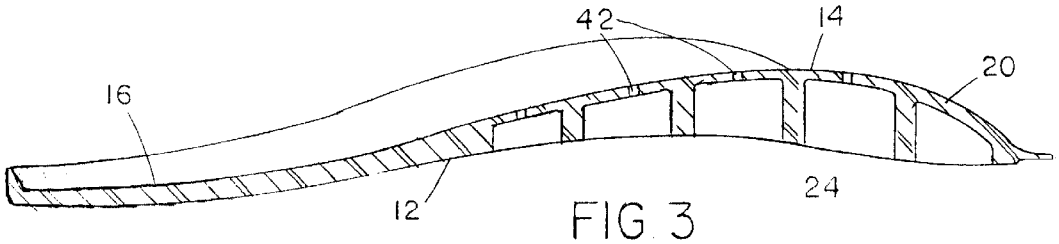
FIG. 3 is a sectional view taken on line 3—3 of FIG. 2.

The forward region 20 of the upper surface has an upwardly bulging or convex shape, as best illustrated in FIG. 3, such that the device is thickest and therefore would tend to be more rigid in this region. However, the rigidity is reduced by the provision of a plurality of diamond shaped indents 24 in the lower surface which extend across the entire forward region of the device to form a waffle-like pattern, as indicated in FIGS. 2 to 4.

The diamond shaped intents 24 are separated by diagonal ribs or walls 25,26 which cross over at a non-perpendicular angle and extend diagonally between opposite sides of the device 10, as best illustrated in FIG. 2. Each indent 24 has opposite acute angle corners 28 and obtuse angle corners 30, with the acute angle corners 28 aligned or parallel with the longitudinal axis of the device 10 and thus the wearer's foot. The waffled region of the lower surface has a generally rectangular shape, with generally straight opposite sides and a straight inner end, and an arcuate forward end which generally follows the curvature of the forward edge 35 of the device. Small triangular indents 36 are provided along the opposite sides at the triangular portions between the outermost diamond shaped indents. Similarly, two triangular indents 38 fill the triangular gaps between the diamond shaped indents at the rear end of the waffled region, and a triangular indent 40 is also provided at the forward edge. Holes or perforations 42 are provided from the inner end of some of the indentations and extend through to the upper surface 12 of the device. The holes 42 are provided in series of spaced, parallel lines extending transversely across the arch support device, for ventilation purposes. The indents 24 may alternatively be of other polygonal shapes with non-perpendicular corners, such as hexagonal or octagonal.

The thickness of each rib or wall separating the adjacent indents is significantly less than in prior arch supports having square shaped waffle indents. In prior arch supports with square indents, the thickness of the web or rib between adjacent indents was of the order of 50% or more of the width of the indent itself. In contrast, in this invention, the thickness of each rib 25 or 26 is only about 25% of the width between opposite side edges of the indent, such that the ratio of the rib or wall thickness to the width of the indent is around 1:4. In one example, the rib thickness was of the order of 3 mm. to 5 mm., while the gap or width across the indent between parallel ribs 25 or 26 was of the order of 10 mm. to 12 mm. The thinner ribs separating the indents will add to the overall flexibility in this region of the arch support. The ratio of the rib or dividing wall thickness to the width of the indent may be in the range from around 1:3 to 1:6 for enhanced flexibility.

Figure 5:
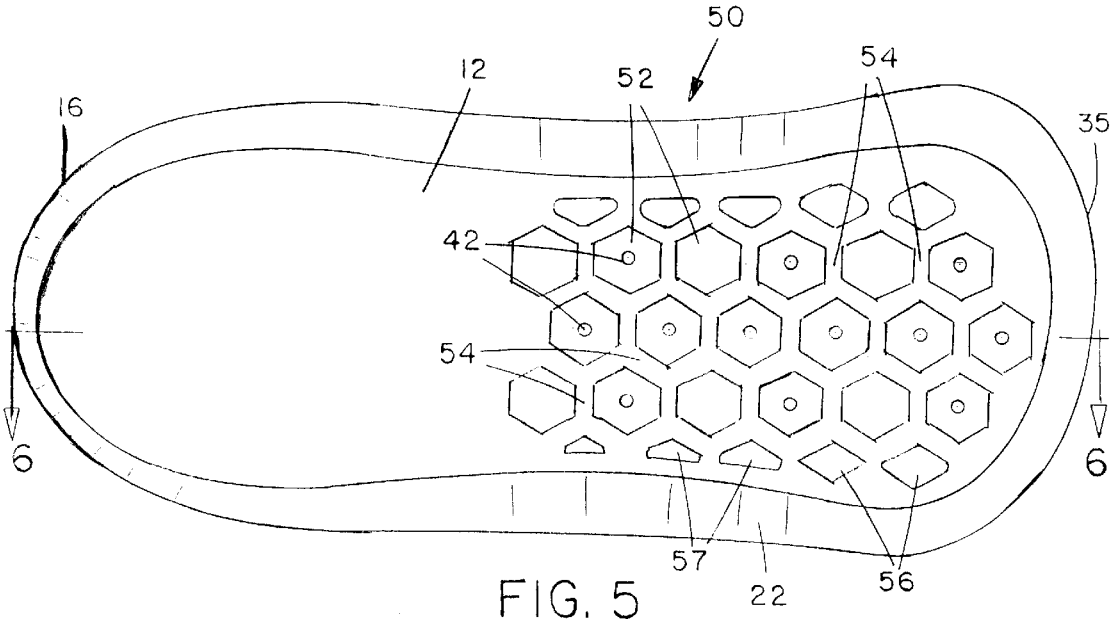
FIG. 5 is a bottom plan view of an arch support according to another embodiment of the invention.
Figure 6:
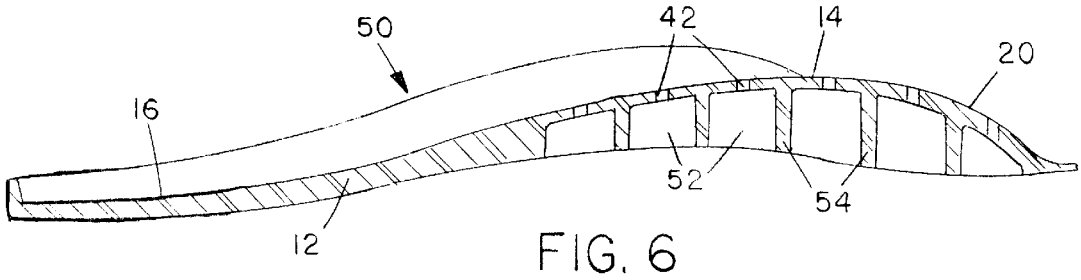
FIG. 6 is a sectional view taken along like 6—6 of FIG. 5.

FIGS. 5 and 6 of the drawings illustrate an arch support device 50 according to another embodiment of the invention in which hexagonal shaped indents 52 are provided in a waffle pattern on the lower surface of the device, rather than diamond shaped indents as in FIGS. 1 to 4. This produces a generally honeycomb-like pattern. The device 50 is otherwise identical to the previous embodiment, and like reference numerals have been used for like parts as appropriate.

In this embodiment, the thickness of the walls or ribs 54 separating adjacent indents is around the same as in the previous embodiments. The walls are relatively thin and have a thickness of the order of 3 mm. to 4 mm. The six sided or hexagonal indents 54 will inherently provide more flexibility than the diamond shaped indents of FIGS. 1 to 4. The width of each hexagonal indent from corner to corner is of the order of 12 to 15 mm., so that the ratio of the wall thickness to the width of the indent is in the range from around 1:3 to 1:5. This means that there is relatively more open space than in prior art insert devices with waffle patterns, where the ratio was typically around 1:2, and this further adds to flexibility in the forward portion of the insert device.

As in the previous embodiment, holes 42 are provided in the base of at least some of the hexagonal indents, for ventilation purposes. The waffled region of the lower surface of the insert device covers the entire forward region of the device, as in the previous embodiment, and has generally straight opposite peripheral edges formed by providing indents 56,57 of diamond or triangular shape, respectively, along the side edges of the waffled region. This ensures that the waffle region is completely filled with indents, without providing an irregular side edge or border to the waffled region.

The polygonal, non-square shape of the indents together with the thinner ribs or walls separating adjacent indents, such that the ratio of the wall thickness to the opening size is much greater, provides less rigidity and more flexibility. Both the insert device of FIGS. 1 to 4 and that of FIGS. 5 and 6 will be considerably more comfortable and flexible than existing insert devices of similar, semi-rigid plastic material which either have no indents at all, or else have square indents with relatively thick side walls. The shape of the polygonal indents, along with the ratio of the wall thickness to the width of each indent, provides increased flexibility in the forward portion of the device, making it more comfortable to wear, and also reducing or eliminating wear-in or break-in time for the user. The hexagonal indents will produce even more flexibility than the diamond indents of FIGS. 1 to 4, making the device even softer to wear. Shoe insert devices of varying flexibility may therefore be provided, and the user can pick the device which is most comfortable for them. Overall, these devices are less restrictive and more accommodating to the foot than prior art, more rigid insert devices.

Although some exemplary embodiments of the invention have been described above by way of example only, it will be understood by those skilled in the field that modifications may be made to the disclosed embodiments without departing from the scope of the invention, which is defined by the appended claims.

I claim:

1. An arch support device, comprising:

a one piece support member having a periphery shaped to conform to at least part of the periphery of the sole of a wearer's footwear, the member having a longitudinal axis, an upper surface, a lower surface, a forward end, and a rear end;

the upper surface being contoured to follow the contours of the sole of a wearer's foot, and having a heel region extending from the rear end, an arch region, and a forward region extending to the forward end, each region being designed to lie under the corresponding regions of a wearer's foot when in use;

the forward region having an upwardly convex contour extending across part of its area; and the lower surface having an integrally formed waffled region lying under the forward region which has a plurality of indents forming a waffle pattern, and walls of pre-determined thickness separating adjacent indents;

the ratio of the wall thickness to the width of an indent being in the range from 1:3 to 1:6.

2. The device as claimed in claim 1, wherein each indent is of polygonal shape.

3. The device as claimed in claim 2, wherein the polygonal shape is non-square.

4. The device as claimed in claim 3, wherein each indent is of diamond shape.

5. The device as claimed in claim 4, wherein the waffled region is of generally rectangular shape with an arcuate front end following the contour of the forward end of the support member, and generally triangular shaped indents are provided around the periphery of the waffled region to fill triangular gaps between adjacent diamond-shaped indents at the periphery.

6. The device as claimed in claim 1, wherein each indent has an inner end wall, and a hole is provided through the inner end wall of at least some of the indents extending through to the upper surface of the support member.

7. The device as claimed in claim 1, wherein the holes are provided in at least half of the indents.

8. An arch support device, comprising:

a support member having a periphery shaped to conform to at least part of the periphery of the sole of a wearer's footwear, the member having a longitudinal axis, an upper surface, a lower surface, a forward end, and a rear end;

the upper surface being contoured to follow the contours of the sole of a wearer's foot, and having a heel region extending from the rear end, an arch region, and a forward region extending to the forward end, each region being designed to lie under the corresponding regions of a wearer's foot when in use;

the forward region having an upwardly convex contour extending across part of its area;

the lower surface having an integrally formed waffled region lying under the forward region which has a plurality of indents forming a waffle pattern, and walls of pre-determined thickness separating adjacent indents;

the ratio of the wall thickness to the width of an indent being in the range from 1:3 to 1:6; and each indent being of hexagonal shape.

9. The device as claimed in claim 1, wherein the wall thickness is of the order of 3 mm. to 5 mm.

10. The device as claimed in claim 9, wherein the width of an indent is of the order of 10 mm. to 15 mm.

11. The device as claimed in claim 1, wherein the ratio is 1:4.

12. An arch support device, comprising:

a support member having a periphery shaped to conform to at least part of the periphery of the sole of a wearer's footwear, the member having a longitudinal axis, an upper surface, a lower surface, a forward end, and a rear end;

the upper surface being contoured to follow the contours of the sole of a wearer's foot, and having a heel region extending from the rear end, an arch region, and a forward region extending to the forward end, each region being designed to lie under the corresponding regions of a wearer's foot when in use;

the forward region having an upwardly convex contour extending across part of its area;

the lower surface having a waffled region lying under the forward region which has a plurality of indents forming a waffle pattern, and walls of predetermined thickness separating adjacent indents;

the ratio of the wall thickness to the width of an indent being in the range from 1:3 to 1:6; and the diamond shape indents each having two opposite acute angle corners and two opposite obtuse angle corners, the acute angle corners lying on lines coincident with or parallel to the longitudinal axis of the support member.

13. An arch support device, comprising:

a one piece support member having a periphery shaped to conform to at least part of the periphery of the sole of a wearer's footwear, the member having a longitudinal axis, an upper surface, a lower surface, a forward end, and a rear end;

the upper surface being contoured to follow the contours of the sole of a wearer's foot, and having a heel region extending from the rear end, an arch region, and a forward region extending to the forward end, each region being designed to lie under the corresponding regions of a wearer's foot when in use;

the forward region having an upwardly convex contour extending across part of its area; and the lower surface having an integrally formed waffled region lying under the forward region which has a plurality of indents of polygonal shape having corners which are not right angles, the indents forming a waffle pattern, and a plurality of ribs extending transverse to one another across the waffled region to separate the indents.

14. The device as claimed in claim 13, wherein the thickness of each rib is no greater than 25% of the width of the indent measured between opposing sides of the indent.

15. An arch support device, comprising:

a one piece support member having a periphery shaped to conform to at least part of the periphery of the sole of a wearer's footwear, the member having a longitudinal axis, an upper surface, a lower surface, a forward end, and a rear end;

the upper surface being contoured to follow the contours of the sole of a wearer's foot, and having a heel region extending from the rear end, an arch region, and a forward region extending to the forward end, each region being designed to lie under the corresponding regions of a wearer's foot when in use;

the forward region having an upwardly convex contour extending across part of its area;

the lower surface having an integrally formed waffle pattern lying under the forward region, the waffle pattern having a plurality of diamond-shape indents each having two opposite acute angle corners and two opposite obtuse angle corners, the acute angle corners lying on lines coincident with or parallel to the longitudinal axis of the support member; and the waffle pattern having interleaved rows of indents extending across the support member, each row having at least two complete diamond-shape indents.

* * * * *